US007530934B2

(12) United States Patent
Garner

(10) Patent No.: US 7,530,934 B2
(45) Date of Patent: May 12, 2009

(54) VARIABLE RESISTANCE FLEXION AND EXTENSION EXCERCISE MACHINE

(76) Inventor: Brian Garner, Baylor University, One Bear Pl., No. 97356, Waco, TX (US) 76798

( * ) Notice: Subject to any disclaimer, the term of this patent is extended or adjusted under 35 U.S.C. 154(b) by 0 days.

(21) Appl. No.: 11/973,206

(22) Filed: Oct. 5, 2007

(65) Prior Publication Data

US 2008/0032875 A1 Feb. 7, 2008

Related U.S. Application Data

(63) Continuation of application No. 10/966,010, filed on Oct. 15, 2004, now abandoned.

(51) Int. Cl.
*A63B 21/008* (2006.01)
*A63B 23/12* (2006.01)

(52) U.S. Cl. ..... 482/112; 482/137

(58) Field of Classification Search ..... 482/97, 482/111–113, 137

See application file for complete search history.

(56) References Cited

U.S. PATENT DOCUMENTS

| | | | | | |
|---|---|---|---|---|---|
| D255,136 | S | * | 5/1980 | Brentham | D21/676 |
| 4,275,882 | A | | 6/1981 | Grosser et al. | |
| 4,387,894 | A | * | 6/1983 | Baumann | 482/112 |
| D271,603 | S | | 11/1983 | Berner | |
| 4,426,077 | A | | 1/1984 | Becker | |
| 4,477,071 | A | | 10/1984 | Brown et al. | |
| 4,618,140 | A | | 10/1986 | Brown | |
| 4,618,144 | A | | 10/1986 | Gibson | |
| 4,627,610 | A | | 12/1986 | Ishida et al. | |
| 4,786,051 | A | | 11/1988 | Mullican | |
| 4,790,530 | A | * | 12/1988 | Maag | 482/137 |
| 4,880,227 | A | | 11/1989 | Sowell | |
| 5,031,905 | A | | 7/1991 | Walsh | |
| 5,037,090 | A | | 8/1991 | Fitzpatrick | |
| 5,039,088 | A | | 8/1991 | Shifferaw et al. | |
| 5,058,888 | A | | 10/1991 | Walker et al. | |
| 5,277,684 | A | | 1/1994 | Harris | |
| 5,352,171 | A | | 10/1994 | Lin | |
| 5,419,750 | A | | 5/1995 | Steinmetz | |
| 5,505,679 | A | | 4/1996 | McBride et al. | |
| 5,605,524 | A | | 2/1997 | Husted | |
| 5,616,107 | A | * | 4/1997 | Simonson | 482/97 |
| 5,665,034 | A | | 9/1997 | Hwang | |
| 5,676,623 | A | | 10/1997 | Yu et al. | |
| 5,685,810 | A | | 11/1997 | Chung | |

(Continued)

FOREIGN PATENT DOCUMENTS

CH 643 744 A5 6/1984

OTHER PUBLICATIONS

International Search Report received in corresponding PCT Application No. PCT/US2005/36555.

*Primary Examiner*—Loan H Thanh
*Assistant Examiner*—Victor K Hwang
(74) *Attorney, Agent, or Firm*—Jackson Walker, LLP

(57) ABSTRACT

An exercise machine including a frame and a drive arm pivotedly engaged to the frame, for example, on an upright thereof. A cylinder is mounted at one point to the frame and, at a removed end of a plunger, has links or rod members to engage the removed end of the plunger to the frame and also to the drive arm.

2 Claims, 6 Drawing Sheets

U.S. PATENT DOCUMENTS 5,743,832 A 4/1998 Sands et al.
5,785,635 A 7/1998 Gerschefske et al.
6,290,630 B1 9/2001 Boland
2005/0101464 A1* 5/2005 Campitelli ..... 482/142

* cited by examiner

VARIABLE RESISTANCE FLEXION AND EXTENSION EXCERCISE MACHINE

This application claims priority from, incorporates by reference, and is a continuation of U.S. patent application Ser. No. 10/966,010, filed Oct. 15, 2004 now abandoned.

FIELD OF THE INVENTION

Flexion and extension exercise machines, more specifically a flexion and extension exercise machine having hydraulic or other resistance means with a fixed and a moveable end, the moveable end fixed by a link to two points, one a point on a frame and the second a point on a user actuated drive arm.

BACKGROUND OF THE INVENTION

Common exercise machines work specific muscle groups by resisting motion in a single degree of freedom, generalized direction. Typically, power is transmitted cyclically over the range of joint motion from the user's muscles, to the skeleton, through the machine interface and mechanical linkage, to the resistance mechanism. The resistance mechanism may be a guided weight, spring, friction belt, hydraulic cylinder or the like.

Biomechanical factors, such as force-length and force-velocity properties of muscle (Zajac 1989), muscle moment arms, and skeletal geometry, influence the capacity of the user to produce force in the generalized direction. These factors result in a generalized strength for the user on a particular machine which varies with both position and velocity over the range of exercise motion. Similarly, the resistance response of the machine may vary with position and velocity due to the mechanical advantage (MA) of the linkage and the properties of the resistance mechanism.

Typical prior art flexion and extension machines such as those used for elbows are illustrated in FIGS. 1A through 1C. They include a drive arm moveable with respect to a frame, the frame typically including upright. The drive arm is pivotally connected to the frame and, the removed end will engage the user's wrist or hand area, which will activate and pivot the drive arm. Since the drive arm is attached to a resistance mechanism, such as weights, springs or a hydraulic cylinder (as shown in FIGS. 1-3), the user must overcome the resistance.

Prior art machines link, for example, a hydraulic cylinder, a fixed point on the cylinder body pivotally to the frame and a point on the removed end of the rod of the hydraulic cylinder to the drive arm. This gives the benefit of balancing user strength and machine resistance by providing variable resistance. Some other existing exercise equipment, such as a Nautilus, employs cables, cams and weight to provide an appropriate variable resistance. In the prior art, "2-bar linkage designs" as set forth in FIGS. 1A and 1B (the two bars being the upright and the pivoting drive arm), at flexion angles between about 0 and 60 degrees (flexion angle measured between the user's upper arm and lower arm), the mechanical advantage of the system increases, then from 60 degrees to about 120 degrees the MA decreases. Thus, variable resistance is achieved.

This "low-high-low" mechanical advantage change as the flexion angle changes between about zero and about 120 degrees tends to balance the generalized strength of the typical user, who is weaker at the lower angles, stronger around 60-80 degrees and then weaker again at high flexion angles greater than about 60-80 degrees. Thus, the variable resistance machine such as the 2-bar design illustrated in FIG. 1A through 1C tends to provide greatest resistance when generalized muscle strength is greatest (60-80 degrees) and less resistance (through lower mechanical advantage) where muscle strength is weaker.

However, Applicant provides a novel linkage that yields better balance in a variable resistance 4-bar pivoting drive arm exercise machine in order to optimize exercise benefits.

Applicant achieves these results in a novel 4-bar flexion and extension machine which typically comprises a hydraulic cylinder having a movable plunger or piston and a hydraulic cylinder body. The hydraulic cylinder body is pivotally attached to a stationary frame or an upright. Also attached to the upright is a pivoting drive arm, actuated by the exerciser machine user. The removed end of the plunger is located, by links, pivotally, to both the stationary frame or upright and the pivoting drive arm.

The result is an improved exercise machine that better balances the variable resistance provided by the machine to the typical general muscle strength variation of user so as to achieve balance and smoothness of movement and consistency of velocity over the desired range of motion.

BRIEF DESCRIPTION OF THE PREFERRED EMBODIMENT

Figure 1C:
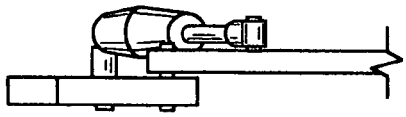
Fig. 1C (PRIOR ART)
FIGS. 1A, 1B and 1C illustrate side, front and top elevational views respectively of prior art "2-bar" elbow flexion and extension exercise machines.
Figure 1A:
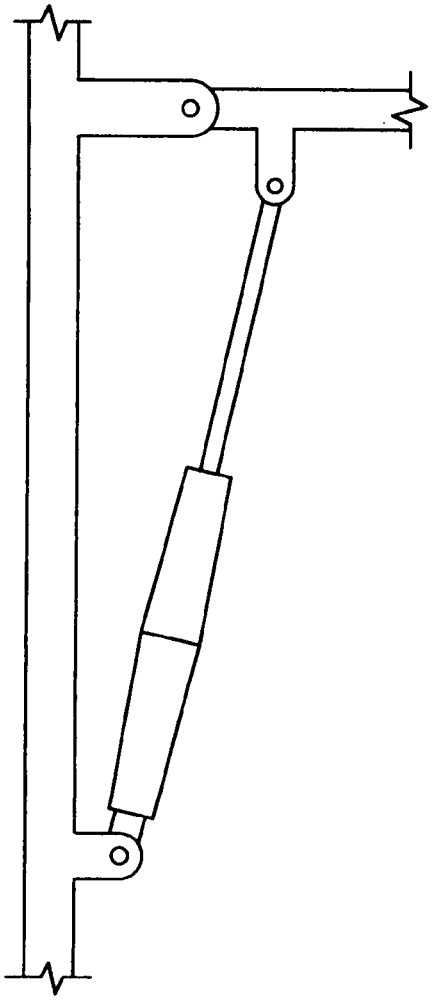
Fig. 1A (PRIOR ART)
Figure 1B:
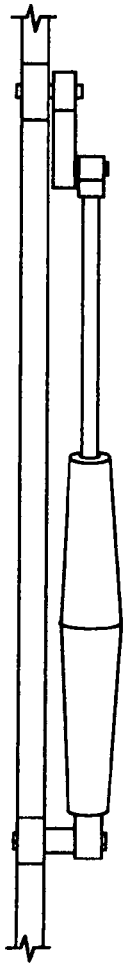
Fig. 1B (PRIOR ART)
Figure 4:
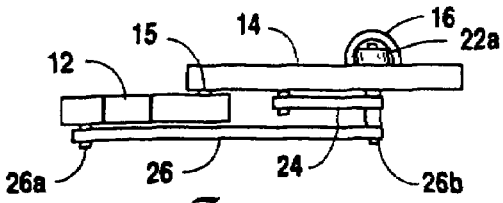
FIGS. 2, 2A, 3 and 4 illustrate Applicant's novel "4-bar" flexion and extension exercise machine in side, side front and top elevational views respectively.

Exercise device (10) is provided, more specifically exercise device (10) for providing variable resistance to flexion and extension motion in the limb of the exercise machine operator.

Exercise device (10) includes a fixed upright (12), typically anchored to or part of a frame attached to or supported by the floor. Pivotally attached to fixed upright (12) is a drive arm (14), the drive arm (14) having a near end (14A) and a removed end (14B). A hand, wrist or distal end of the forearm may engage the removed end of the drive arm to move it pivotally between a position represented by extension of the forearm and a position represented by flexion of the same. Drive arm (14) engages fixed upright (12) at drive arm/upright pivot (15), which pivot point may be affected by use of a bolt or fastener or other means known in the art.

A hydraulic cylinder (16) is provided for engagement between the fixed upright and the drive arm as more specifically set forth below, the hydraulic cylinder (16) or other resistance mechanism to provide resistance to the pivot action (driven by the exerciser) of the drive arm (14).

It is seen with respect to FIGS. 2 through 11 that hydraulic cylinder (16) is comprised of a body (18) having a removed end (18A) and a piston assembly (20) including a piston plunger or rod (22) having a removed end (22A). Further, it is seen that removed end (18A) of body (18) is pivotally mounted to upright (12) or the frame, for example (but not necessarily) on a standoff (13). Moreover, it is seen that Applicant provides a novel engagement of removed end (22A) of the rod (22), attaching the rod to both a point on the upright through the use of a rocker link (26) and to a point on the moveable drive arm (14) through use of a coupler link (24). It is seen that rocker link (26), through its length, determines the radius of curvature transcribed by removed end (22A). Further, it is seen that the geometry of the cylinder/frame/drive arm will change as the drive arm is pivoted, thus changing the MA of the system.

More specifically, it is seen that Applicant provides for a hydraulic cylinder (16) that is pivotally coupled at a first end to the fixed upright or frame of an exercise machine and, at a removed end of the plunger of the hydraulic cylinder, is pivotally coupled through a member to the upright and which removed end is also pivotally coupled to the drive arm through a second member. The net effect of using such a "4-bar" mechanism is to provide a variable resistance to the exertion force of the user muscles. This variable resistance force closely matches the variable torque applied by the user throughout the angular movement of the drive arm. Matching machine resistance to user applied torque effects a smooth constant angular velocity ("balance") through the angular positions between flexion to extension.

Note in FIGS. 5 through 7 and 8 through 10, alternate preferred embodiments, a number of additional/alternative features. In the embodiment illustrated in FIGS. 5 through 7, means, here holes (28) are provided in the drive arm such that the coupler link (24) may be adjustably positioned along the drive arm so as to effect a change in mechanical advantage and balance between the user's general muscle strength and the resistance provided by the machine. Further, holes (29) may be provided where the rocker link engages the frame or upright as in FIG. 2 for further adjustment. A slot and fastener arrangement known in the art (not shown) may be used in place of holes (28/29). The fasteners known in the trade can be used to fasten any of the pivot or joints set forth in all the embodiments to the invention and may be used to adjustably set the location of the coupler link along the drive arm.

Figure 2:
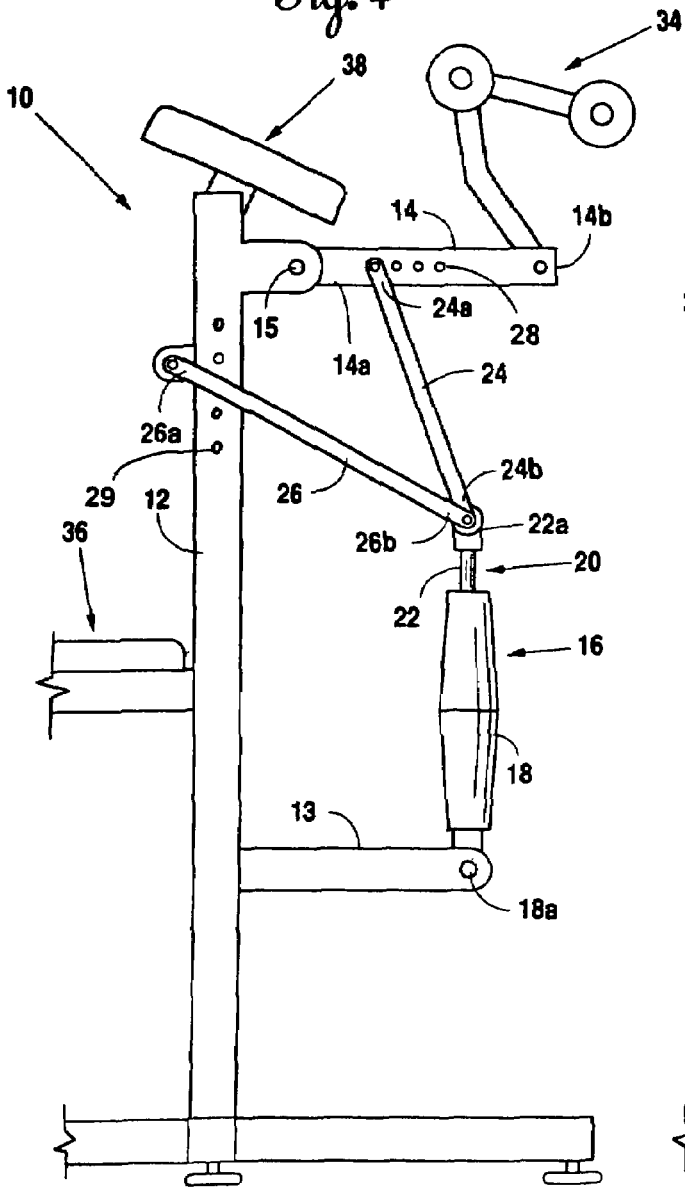
Figure 3:
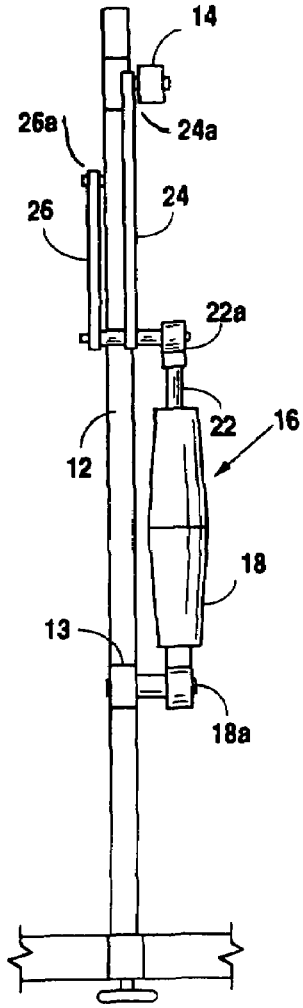
Figure 2A:
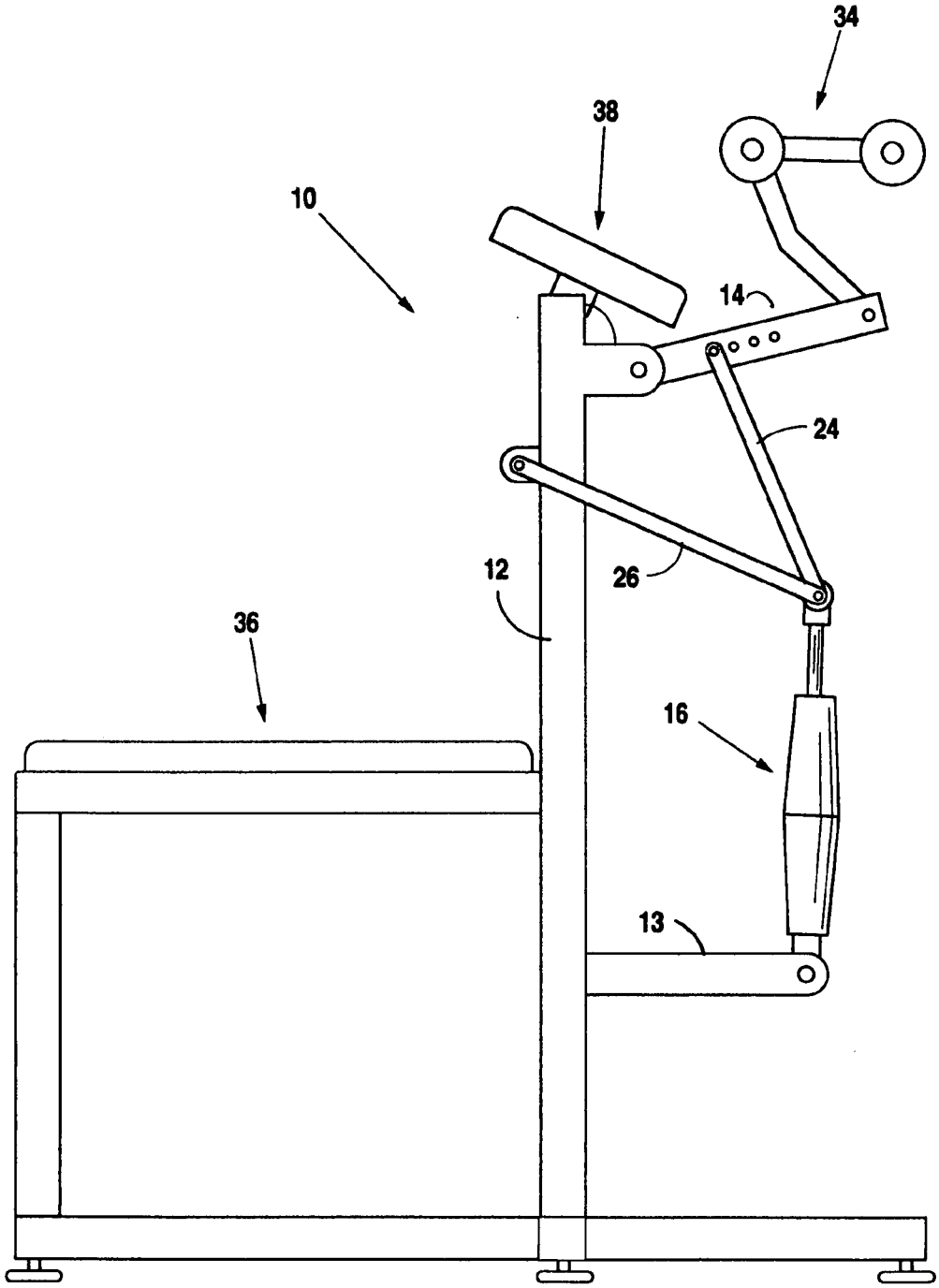
Figure 7:
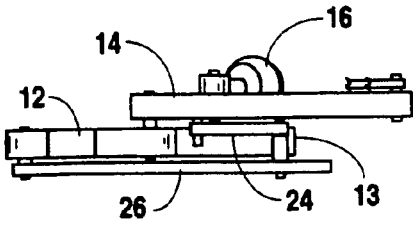
FIGS. 5, 6 and 7 represent side elevational, front elevational and top elevational views respectively of an alternate preferred embodiment of Applicant's novel invention, wherein the removed end of the plunger is attached to the rocker link.
Figure 5:
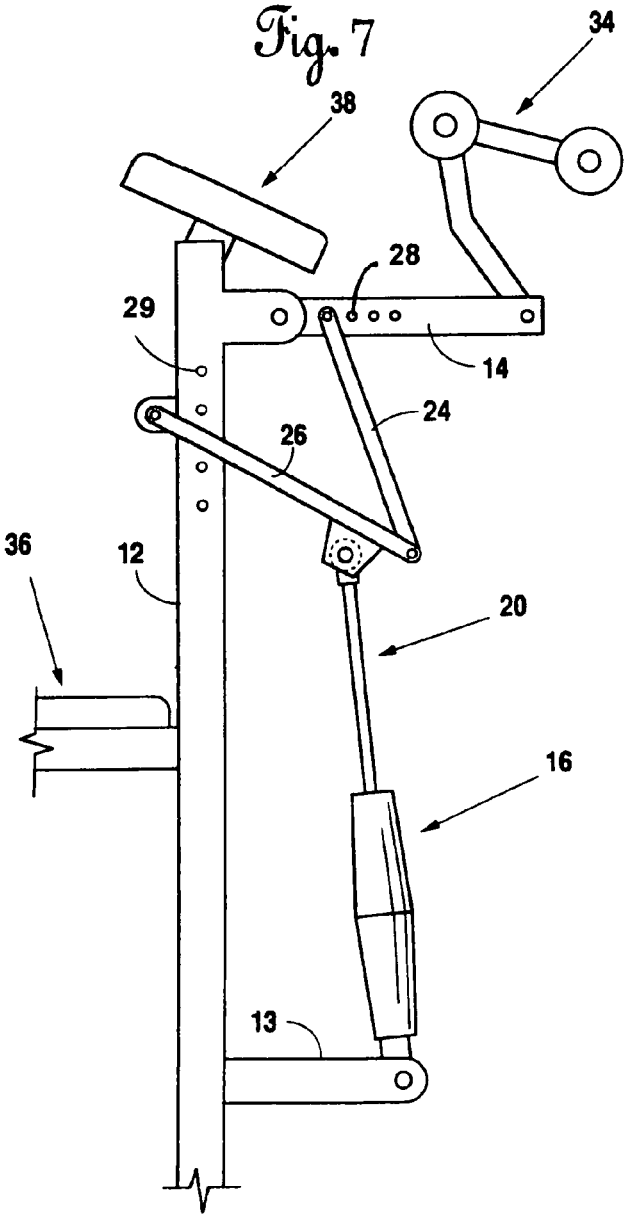
Figure 6:
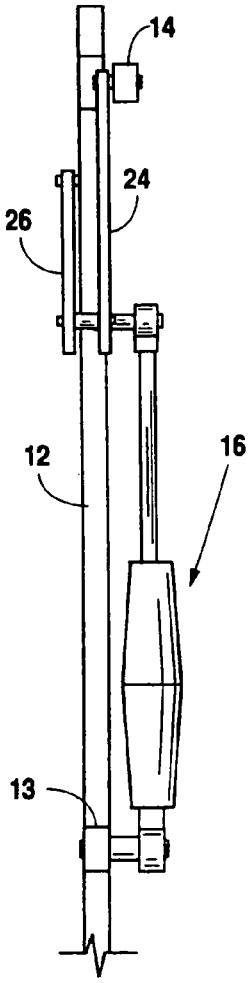
Figure 10:
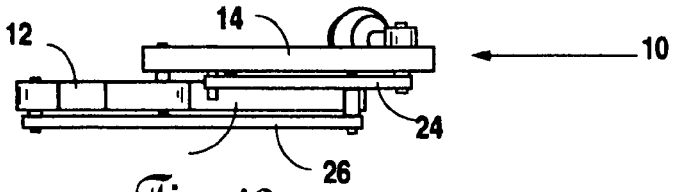
FIGS. 8, 9 and 10 illustrate yet another novel embodiment of Applicant's flexion and extension exercise device, in side, front and top elevational views respectively, illustrating the removed end of the plunger attached to the coupler link.
Figure 8:
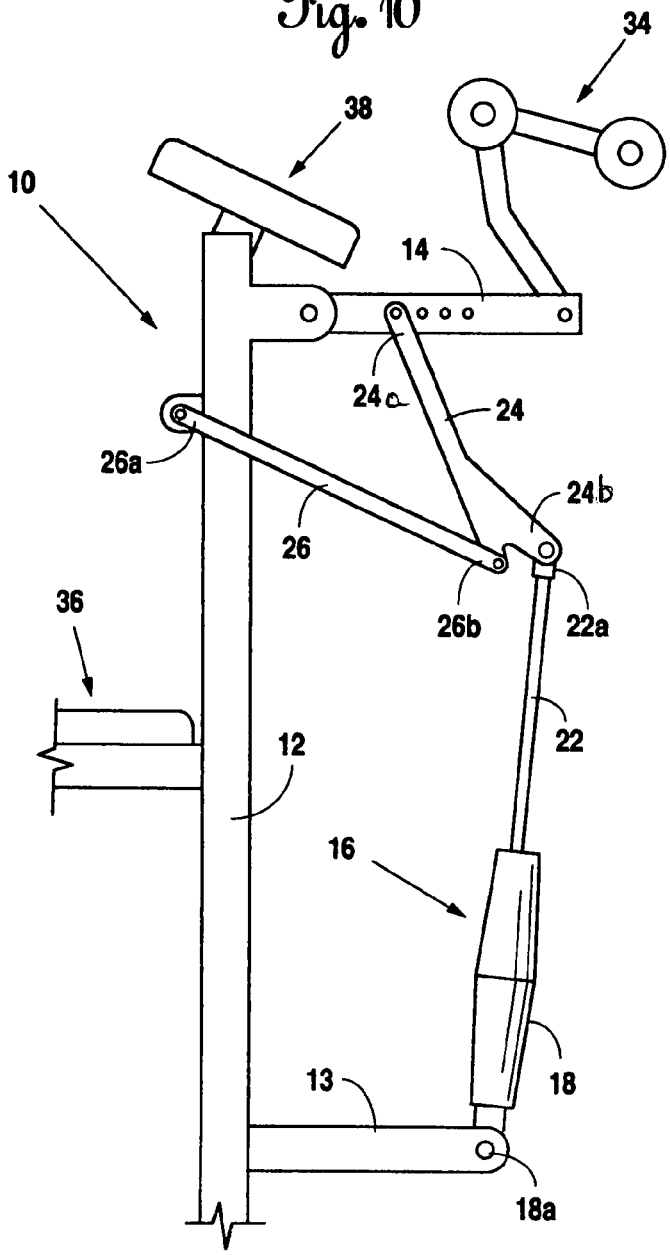
Figure 9:
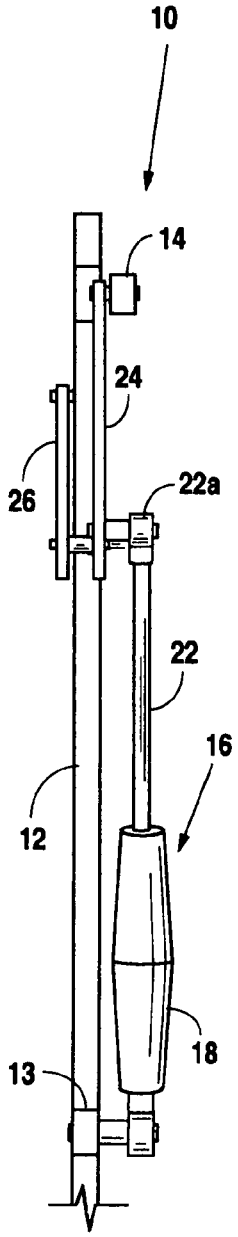

FIGS. 5 through 7 and 8 through 10 also illustrate that the removed end of the rod may be attached, instead of to the removed ends of the coupler and rocker link as set forth in FIG. 2, the plunger may be pivotally engaged with one or the other of the coupler link (FIGS. 8 through 10) or rocker link (FIGS. 5 through 7).

Further, standoffs may be provided on the drive arm to pivotally mount the coupler link thereto. Likewise, standoffs are illustrated in all of the embodiments, to provide attachment of the rocker link to the upright, however standoffs need not necessarily be used.

Figure 11:
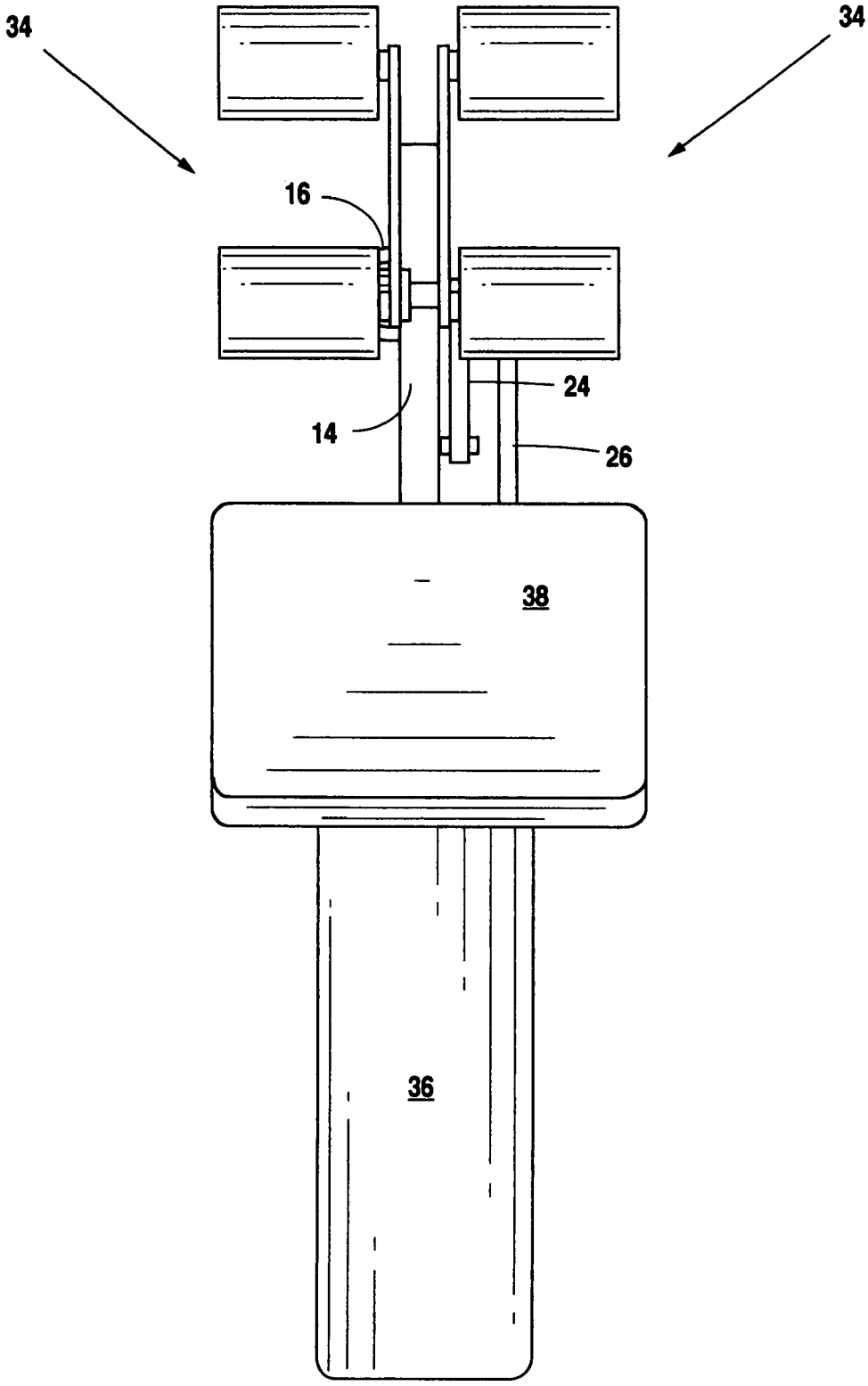
FIG. 11 illustrates a preferred alternate embodiment of Applicant's exercise device showing a side-by-side arrangement of the arm or wrist engagement assembly so a user may use one assembly for the left arm and the other for the right arm.

While the preferred embodiments show single coupler links and single rocker links, of course they could be a pair adjacent to one another to form the same link that is achieved with a single bar member. Further, as seen in FIG. 11, there could be in a preferred embodiment left hand and right hand drive arm or other link engagement assemblies (34) attached to the removed end of a single drive arm. FIG. 11 also shows seat (36) and upper arm rest (38).

The machine's resistance response increases nonlinearly with increasing velocity at each joint position. However, due to the force/length properties of muscle, the strength capacity of the elbow decreases with increasing angular velocity. During exercise, the machine naturally operates at the angular velocity where the machine resistance intersects strength capacity for the joint at each elbow angle.

To achieve balance between machine resistance and participant's strength, prior art machines have been modified so that the natural operating speed would be theoretically constant throughout the range of joint motion. The use of Applicant's novel 4-bar mechanism results in operating speeds (angular velocity and degrees per second) nearly constant over flexion angles from less than 20 degrees to greater than 120 degrees indicating an improved balance between resistance response of the machine and generalized strength of the user.

Applicant's cylinder provides increased force response to increased displacement velocity—indeed almost quadratically. That is to say, if one attempts to pivot the drive arm at a greater velocity, the cylinder responds nonlinearly, indeed almost quadratically to increase the resistance force. This is important in that a relatively weak user and a relatively strong user will achieve generally similar angular velocities even with a difference in the torque applied to the machine.

While the extension and flexion device is illustrated here with respect to flexion and extension the arm at the elbow, in fact it could be used with any type of machine, including those exercising the legs, knees, chest press/back pull, abdominal rotation, or other parts of the body. Furthermore, in place of a hydraulic cylinder a friction type device such as friction belt or the like or other velocity dependent (more resistance with increased velocity of drive arm) resistance means could be used.

Further, the specifications disclose a method of providing a friction device, such as a hydraulic cylinder, which friction device may include a resistance rod or arm. The novel method will affix one part of the friction device (such as the body of an hydraulic cylinder) to the frame of the exercise arm and link the resistance arm pivotally to both the frame of the machine and the machine user activated drive arm.

While upright (12) is illustrated, it is intended to cover any stationary part of a frame of the machine, and it need not be vertical.

The illustrations show a dampener with a removed end of the plunger mounted as set forth with the two links. However, it is also possible to mount the cylinder so that the removed end of the body has the coupler and rocker links engaged therewith.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. An exercise machine for exercising the arm, the machine comprising:

a frame including a generally vertical upright;

a drive arm pivotally mounted to the frame at a drive arm pivot point and moveable between a rest position and an extension position wherein the drive arm is extending outward from the upright in a first direction, the drive arm including a plurality of holes;

a seat assembly extending outward from the upright in a second direction generally opposite the first direction, the seat assembly located below the drive arm;

an arm engagement assembly above and statically affixed to the drive arm and configured to receive an arm of a user, the arm engagement assembly including a first branch affixed to the drive arm at an acute angle and a second branch affixed to the first branch at an acute angle;

a coupler link pivotally attached to the drive arm at one of the plurality of holes and directed generally downward with respect to the drive arm, the coupler link adapted to be adjustable with respect to the plurality of holes;

a rocker arm engaging the upright at a near end below the drive arm pivot point and at a far end pivotally attached to a far end of the coupler link;

the coupler link and rocker arm forming a rocker-coupler assembly;

a hydraulic piston and cylinder assembly providing variable resistance and pivotally attached to and below the rocker-coupler assembly;

a standoff adapted to locate the piston and cylinder assembly spaced apart from the upright in the first direction and pivotally engaging a removed end of the piston and cylinder assembly so as to maintain the piston and cylinder assembly substantially below the coupler-rocker assembly and substantially outside an area enclosed by the coupler-rocker assembly, drive arm and upright;

whereby the piston and cylinder assembly provides bi-directional resistance that increases with increased displacement velocity and increases non-linearly at each joint position;

the second branch of the arm engagement assembly is adapted to accommodate a bicep exercise;

the first branch of the arm engagement assembly is adapted to accommodate a triceps exercise; and the hydraulic piston and cylinder assembly provides bi-directional resistance.

2. The exercise machine of claim 1 wherein the drive arm, coupler link, rocker arm, and piston and cylinder assembly all lie in substantially a single vertical plane.

* * * * *